US011254528B2

(12) United States Patent
Ichikawa

(10) Patent No.: US 11,254,528 B2
(45) Date of Patent: Feb. 22, 2022

(54) PAPER FEED TRAY AND IMAGE FORMING APPARATUS

(71) Applicant: KONICA MINOLTA, INC., Tokyo (JP)

(72) Inventor: Yoshitada Ichikawa, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 140 days.

(21) Appl. No.: 16/538,903

(22) Filed: Aug. 13, 2019

(65) Prior Publication Data

US 2020/0071106 A1 Mar. 5, 2020

(30) Foreign Application Priority Data

Aug. 28, 2018 (JP) ..... JP2018-159199

(51) Int. Cl.
*B65H 1/04* (2006.01)
*B65H 9/04* (2006.01)
(Continued)

(52) U.S. Cl.
CPC ..... *B65H 1/04* (2013.01); *B41J 11/22* (2013.01); *B65H 1/266* (2013.01); *B65H 9/04* (2013.01);
(Continued)

(58) Field of Classification Search
CPC .. B65H 1/04; B65H 1/266; B65H 2405/1122; B65H 2405/1134; B65H 2405/114;
(Continued)

(56) References Cited

U.S. PATENT DOCUMENTS

2016/0185540 A1* 6/2016 Kaiga ..... B65H 1/04 271/171
2016/0200531 A1* 7/2016 Ishida ..... B65H 1/266 271/171

(Continued)

FOREIGN PATENT DOCUMENTS

JP 2015020886 A 2/2015

OTHER PUBLICATIONS

Merriam-Webster Dictionary, pp. 1-6 (Year: 2021).*

(Continued)

*Primary Examiner* — Prasad V Gokhale
(74) *Attorney, Agent, or Firm* — Buchanan Ingersoll & Rooney PC

(57) ABSTRACT

A paper feed tray includes a cassette, a regulation plate which is slidably attached to the cassette, a cover provided to the regulation plate, a locking portion which is covered with the cover and engages with the cassette to fix a position of the regulation plate, and a lever. The lever includes a coupling portion coupled with the locking portion, a depression portion configured to be depressed toward one side in a direction of sliding of the regulation plate, and an intermediate portion provided between the coupling portion and the depression portion. The lever operates the locking portion to be disengaged from the cassette upon the depression portion being depressed toward the one side. The cover includes an extension extending while facing the intermediate portion. A space, which is open at a tip to which the extension extends, is formed between the extension and the intermediate portion.

10 Claims, 7 Drawing Sheets

(51) Int. Cl.
*B65H 1/26* (2006.01)
*B41J 11/22* (2006.01)
*G03G 15/00* (2006.01)

(52) U.S. Cl.
CPC ... *G03G 15/6502* (2013.01); *B65H 2404/721* (2013.01); *B65H 2404/725* (2013.01); *B65H 2405/114* (2013.01); *B65H 2405/115* (2013.01); *B65H 2405/141* (2013.01); *B65H 2511/12* (2013.01)

(58) Field of Classification Search
CPC .. B65H 2405/1142; B65H 2405/11425; B65H 2405/1144; B65H 2405/115; B65H 2405/141; B65H 2402/64; B65H 2404/721; B65H 2404/722; B65H 2404/725; B65H 2511/11; B65H 2511/12
See application file for complete search history.

(56) References Cited

U.S. PATENT DOCUMENTS

2018/0319611 A1* 11/2018 Tahara ..... B65H 1/08
2018/0346266 A1* 12/2018 Ishida ..... B65H 1/04
2019/0218046 A1* 7/2019 Mizuguchi ..... B65H 1/266

OTHER PUBLICATIONS

First Office Action dated Sep. 24, 2021, by the State Intellectual Property Office of People's Republic of China in corresponding Chinese Patent Application No. 201910781082.0 and an English translation (15 pages).

* cited by examiner

PAPER FEED TRAY AND IMAGE FORMING APPARATUS

The entire disclosure of Japanese Patent Application No. 2018-159199, filed on Aug. 28, 2018, is incorporated herein by reference in its entirety.

BACKGROUND

Technological Field

The present invention relates to a paper feed tray and an image forming apparatus.

Description of the Related Art

For example, Japanese Laid-Open Patent Publication No. 2015-20886 discloses a medium cassette including a rear side guide for guiding recording paper, a locking member for regulating a position of the rear side guide, and an operational lever for causing the locking member to perform an unlocking operation.

SUMMARY

As disclosed in Japanese Laid-Open Patent Publication No. 2015-20886, a paper feed tray is known that includes a regulation plate (rear side guide) for regulating a position of a sheet of paper, a locking portion (locking member) for fixing a position of the regulation plate, and a lever (operational lever) for causing the locking portion to perform an unlocking operation.

In such a paper feed tray, a user can slide the regulation plate while depressing the lever in one direction to adjust the position of the regulation plate. However, a user, who is a person with disabilities with the hands, may not easily adjust the position of the regulation plate.

The present invention has been made to solve the above problem and therefore has an object to provide a paper feed tray having excellent operability in adjustment of a position of a regulation plate and an image forming apparatus including the paper feed tray.

To achieve at least one of the abovementioned objects, according to an aspect of the present invention, a paper feed tray reflecting one aspect of the present invention comprises a cassette in which a sheet of paper is placed, a regulation plate which is slidably attached to the cassette and regulates a position of the sheet of paper, a cover provided to the regulation plate, a locking portion which is covered with the cover and engages with the cassette to fix a position of the regulation plate, and a lever. The lever includes a coupling portion covered with the cover and coupled with the locking portion, a depression portion configured to be depressed toward one side in a direction of sliding of the regulation plate, and an intermediate portion provided between the coupling portion and the depression portion. The lever operates the locking portion to be disengaged from the cassette upon the depression portion being depressed toward the one side. The cover is provided opposite to the one side with the lever therebetween and includes an extension extending while facing the intermediate portion. A space, which is open at a tip to which the extension extends, is provided between the extension and the intermediate portion.

To achieve at least one of the abovementioned objects, according to one aspect of the present invention, an image forming apparatus reflecting one aspect of the present invention comprises the paper feed tray and an apparatus body to which the paper feed tray is attached.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
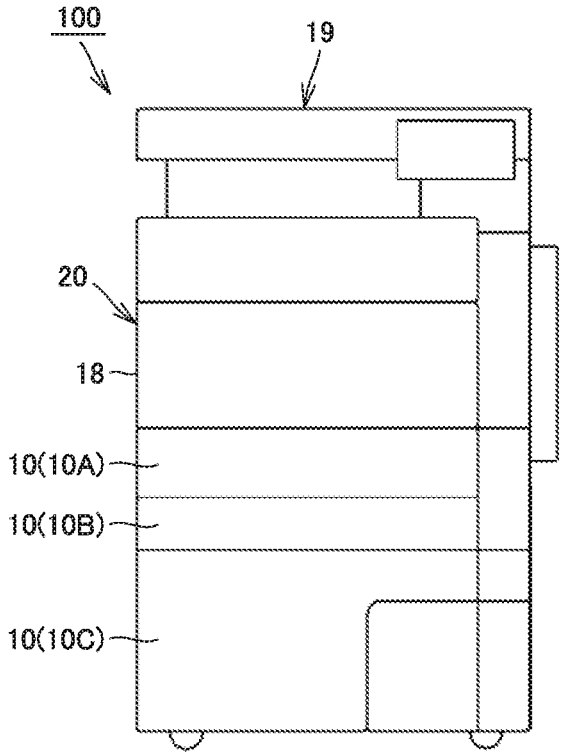
FIG. 1 shows appearance of an image forming apparatus including a paper feed tray according to Embodiment 1 of the present invention.

Hereinafter, one or more embodiments of the present invention will be described with reference to the drawings. However, the scope of the invention is not limited to the disclosed embodiments. In the drawings which are referred to hereinafter, identical or corresponding members are identically denoted.

Embodiment 1

Figure 2:
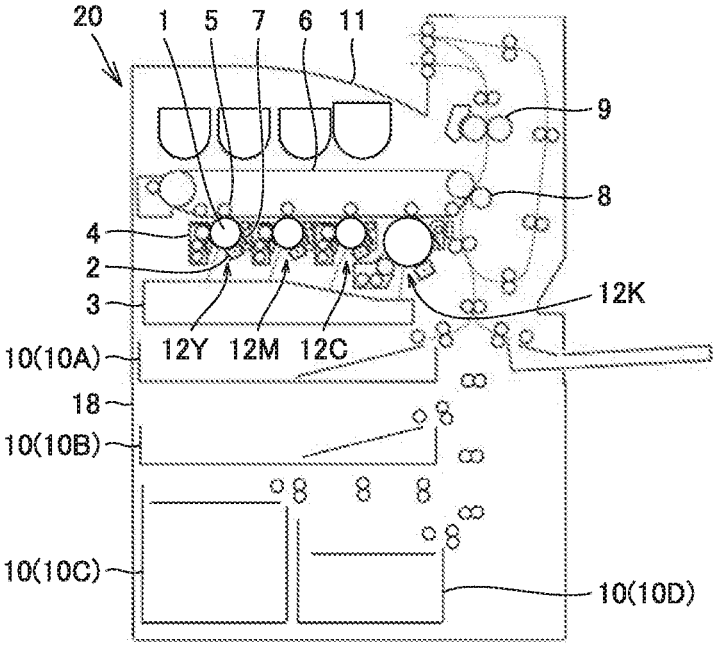
FIG. 2 is a sectional view schematically showing an internal structure of an image forming device in FIG. 1.

FIG. 1 shows appearance of an image forming apparatus including a paper feed tray in Embodiment 1 of the present invention. FIG. 2 is a sectional view schematically showing an internal structure of an image forming device in FIG. 1.

Referring to FIGS. 1 and 2, an image forming apparatus 100 may be a color printer, a monochrome printer or facsimile machine, or a multi functional peripheral (M P) including a monochrome printer, a color printer, and a facsimile machine.

Image forming apparatus 100 includes an image reading device (scanner) 19 and an image forming device 20. Image reading device 19 reads an image of a document placed in a document tray. Image forming device 20 forms an image on a sheet of paper.

Image forming device 20 includes an apparatus body 18 and a plurality of paper feed trays 10 (10A, 10B, 10C, 10D).

Apparatus body 18 includes image forming units 12Y, 12M, 12C, and 12K, an intermediate transfer belt 6, a secondary transfer roller 8, a fixing device 9, and a paper ejection tray 11. Paper feed trays 10 are provided to apparatus body 18.

Image forming units 12Y, 12M, 12C, and 12K each have a photoconductor 1 (image carrier), a charging device 2, an exposure device 3, a developing device 4, a primary transfer roller 5, and a cleaning blade 7. Image forming units 12Y, 12M, 12C, and 12K use such devices to form toner images of yellow (Y), magenta (M), cyan (C), and black (K) colors on the surface of intermediate transfer belt 6.

The toner images of the respective colors are superimposed on the surface of intermediate transfer belt 6. Subsequently, intermediate transfer belt 6 conveys a color toner image to a secondary transfer portion between intermediate transfer belt 6 and secondary transfer roller 8.

Paper feed tray 10 is configured to store sheets of paper. Paper feed trays 10 generally store sheets of paper of different sizes. Paper feed tray 10A and paper feed tray 10B have a shallow case shape. Paper feed tray 10C and paper feed tray 10D have a deep case shape. Paper feed tray 10A and paper feed tray 10B are provided at the upper stage and the middle stage, respectively. Paper feed tray 10C and paper feed tray 10D are provided at the lower stage.

The layout of paper feed trays 10 in image forming apparatus 100 is merely an example and may be changed as appropriate. Alternatively, only one paper feed tray 10 may be provided.

The sheets of paper stored in paper feed tray 10 are conveyed to the secondary transfer portion between intermediate transfer belt 6 and secondary transfer roller 8 using various types of rotary rollers. A color toner image carried on intermediate transfer belt 6 is transferred onto the surface of the sheet of paper in the secondary transfer portion. The color toner image is fixed onto the surface of the sheet of paper by fixing device 9. The sheet of paper on which an image is formed through the above steps is ejected to paper ejection tray 11.

Figure 3:
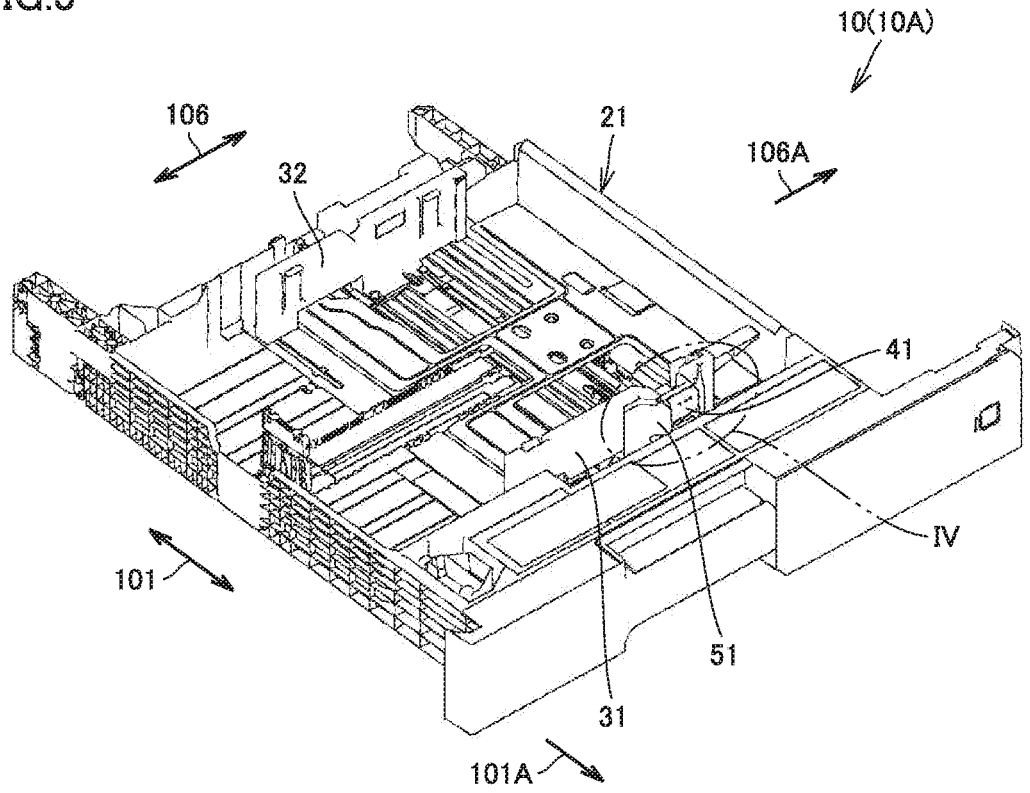
FIG. 3 is a perspective view of the paper feed tray in Embodiment 1 of the present invention.

Next, the structure of paper feed tray 10 will be described in detail. FIG. 3 is a perspective view of the paper feed tray in Embodiment 1 of the present invention. FIG. 3 shows paper feed tray 10A in FIG. 1 as a typical example.

Referring to FIG. 3, paper feed tray 10 includes a cassette 21, a regulation plate (front side) 31, and a regulation plate (rear side) 32.

Sheets of paper are placed in cassette 21. Cassette 21 has the shape of a case, which has a flat bottom and is open upward, as a whole. Cassette 21 has an approximately rectangular shape in top view.

The sheets of paper placed in cassette 21 are fed in one direction (the direction indicated by an arrow 106A) along the direction indicated by an arrow 106. Cassette 21 is provided to be slidable with respect to apparatus body 18 in FIG. 2 in the direction orthogonal to a direction of feeding (the direction indicated by an arrow 101). When sheets of paper are supplied to cassette 21, cassette 21 is drawn from apparatus body 18 toward the front of the apparatus (the direction indicated by an arrow 101A) in the direction indicated by arrow 101.

Regulation plate 31 and regulation plate 32 have the shape of a plate rising upward from the bottom of cassette 21 and extending in the direction indicated by arrow 106. Regulation plate 31 and regulation plate 32 are spaced from each other in the direction indicated by arrow 101. Regulation plate 31 and regulation plate 32 each contact a corresponding one of the opposite ends of the sheet of paper to regulate the position of the sheet of paper. Regulation plate 31 and regulation plate 32 regulate the position of the sheet of paper indicated by arrow 101.

Regulation plate 31 and regulation plate 32 are slidably attached to cassette 21. Regulation plate 31 and regulation plate 32 are provided to be slidable in the direction indicated by arrow 101. The direction in which regulation plate 31 and regulation plate 32 slide is parallel to the direction in which cassette 21 is drawn.

In a typical example, regulation plate 31 and regulation plate 32 are coupled to each other to slide in conjunction with each other. When the user slides regulation plate 31 toward the front of the apparatus, regulation plate 32 slides toward the rear of the apparatus, resulting in an increased distance between regulation plate 31 and regulation plate 32. When the user slides regulation plate 31 to the rear of the apparatus, regulation plate 32 slides toward the front of the apparatus, resulting in a reduced distance between regulation plate 31 and regulation plate 32. Consequently, the distance between regulation plate 31 and regulation plate 32 is adjustable to the spacing matching the size of the sheet of paper (the width of the sheet of paper) placed in cassette 21.

Figure 4:
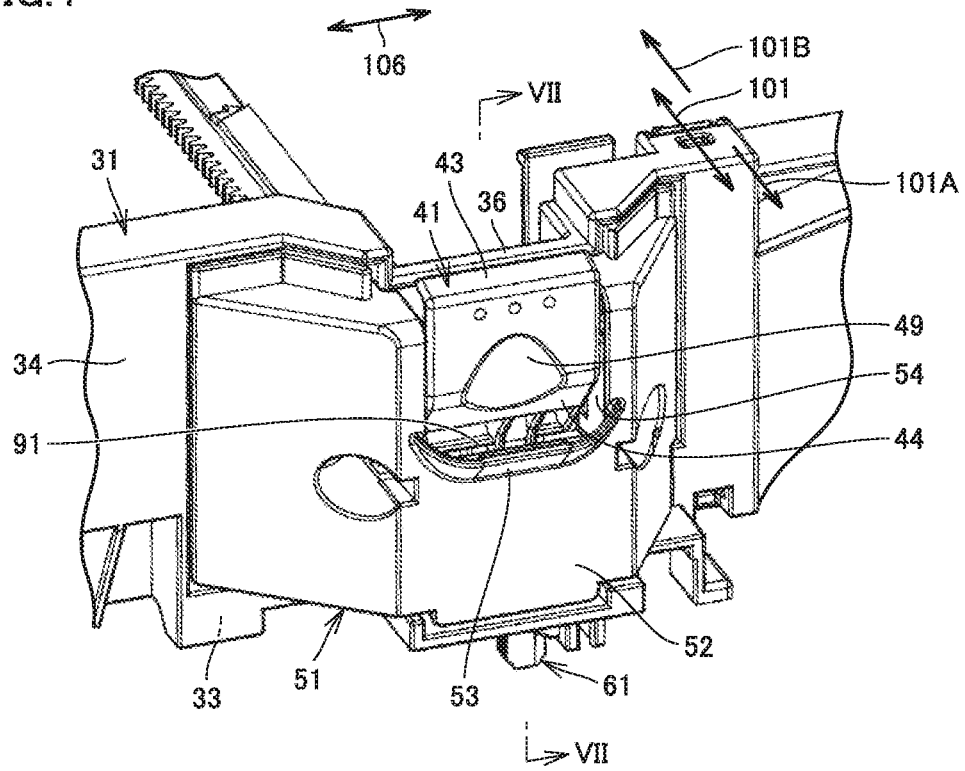
FIG. 4 is a perspective view of the paper feed tray in a range surrounded by a chain double-dashed line IV in FIG. 3.
Figure 5:
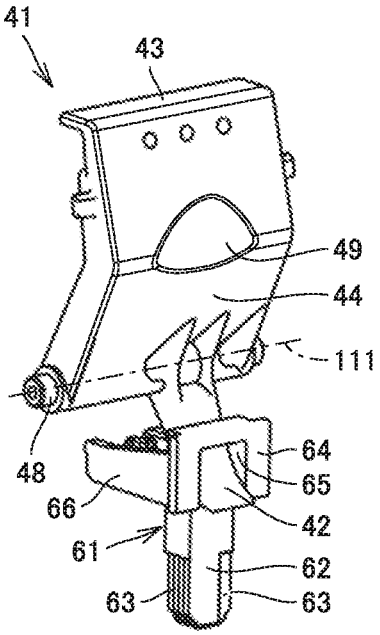
FIG. 5 is a perspective view of a locking portion and a lever.
Figure 6:
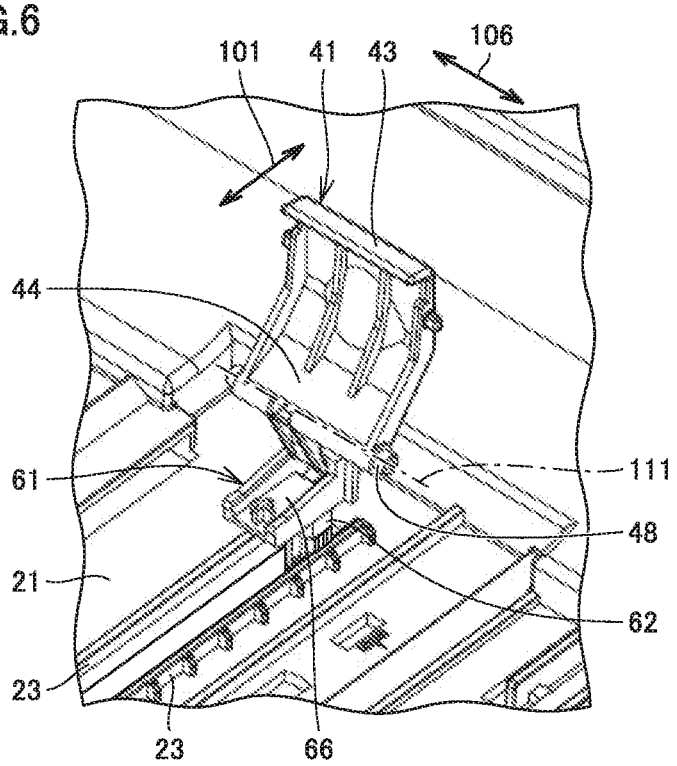
FIG. 6 is a perspective view of a cassette, the locking portion, and the lever (during locking).
Figure 7:
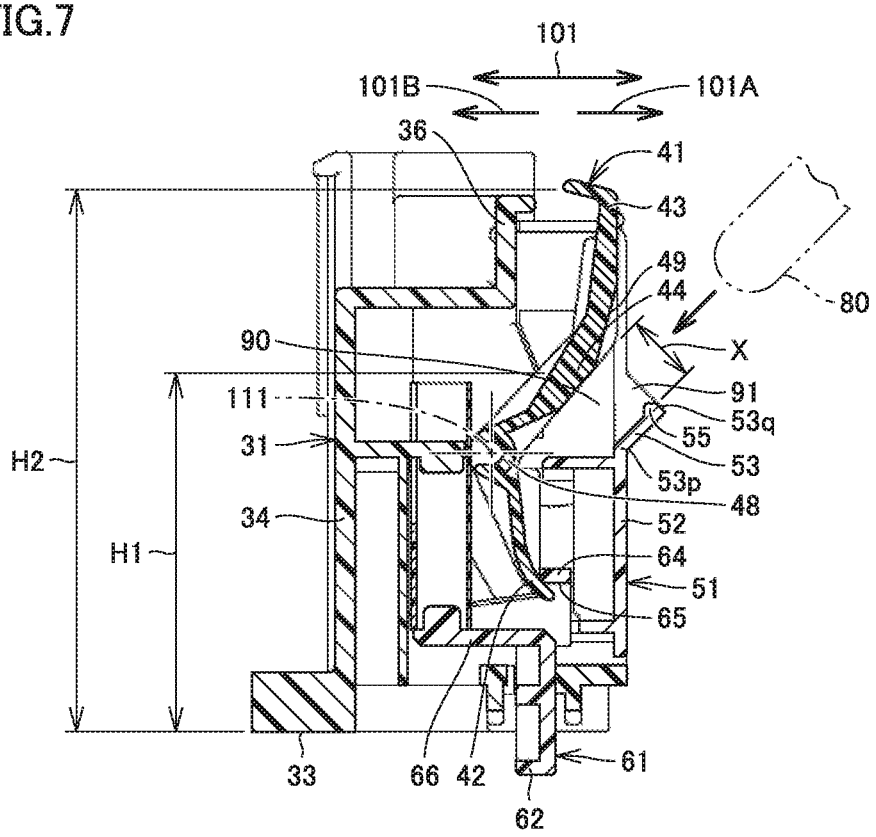
FIG. 7 is a sectional view of the paper feed tray (during locking) as viewed in the direction indicated by a line VII-VII in FIG. 4.

FIG. 4 is a perspective view of the paper feed tray in a range surrounded by a chain double-dashed line IV in FIG. 3. FIG. 5 is a perspective view of a locking portion and a lever. FIG. 6 is a perspective view of the cassette, the locking portion, and the lever (during locking). FIG. 7 is a sectional view of the paper feed tray (during locking) as viewed in the direction indicated by a line VII-VII in FIG. 4.

Referring to FIGS. 4 to 7, paper feed tray 10 further includes a cover 51, a locking portion 61, and a lever 41.

Locking portion 61 and lever 41 constitute a lock/unlock mechanism of regulation plate 31 with respect to cassette 21.

Cover 51 is provided to regulation plate 31. Cover 51 is configured separately from regulation plate 31. Cover 51 is attached to regulation plate 31 from the side opposite to regulation plate 32 in the direction indicated by arrow 101. Cover 51 may be configured integrally with regulation plate 31.

Locking portion 61 is provided to regulation plate 31. Locking portion 61 is covered with cover 51. Locking portion 61 engages with cassette 21 to fix the position of regulation plate 31.

Locking portion 61 includes a projection 62, a receiving portion 64, and a spring support 66 as its components. Projection 62 has the shape of a shaft projecting downward. Projection 62 has mesh portions 63. Mesh portions 63 are provided on the opposite surfaces of projection 62 facing in the direction indicated by arrow 106. Mesh portion 63 has teeth extending linearly in the up-down direction and arranged in the direction indicated by arrow 101.

Receiving portion 64 is provided at the upper end of projection 62. Receiving portion 64 has a ring shape. Receiving portion 64 has a hole 65 passing therethrough in the direction indicated by arrow 101. Spring support 66 runs from the upper end of projection 62 toward the rear of the apparatus in the direction indicated by arrow 101. Spring support 66 supports a spring (not shown). A downward elastic force from the spring is exerted on spring support 66.

Cassette 21 has a pair of rack portions 23 (see FIG. 6). The pair of rack portions 23 are provided with a given spacing therebetween in the direction indicated by arrow 106. The pair of rack portions 23 run parallel to each other in the direction indicated by arrow 101. The opposite surfaces of the pair of rack portions 23 are provided with teeth which run linearly in the up-down direction and are arranged in the direction indicated by arrow 101.

Locking portion 61 is supported to be slidable in the up-down direction by regulation plate 31. The elastic force of the spring (not shown) acts on spring support 66, causing locking portion 61 to slide downward. At this time, projection 62 is inserted between the pair of rack portions 23, causing mesh portion 63 to mesh with the pair of rack portions 23. This results in engagement of locking portion 61 and cassette 21, so that the position of regulation plate 31 in the direction indicated by arrow 101 is fixed.

Figure 8:
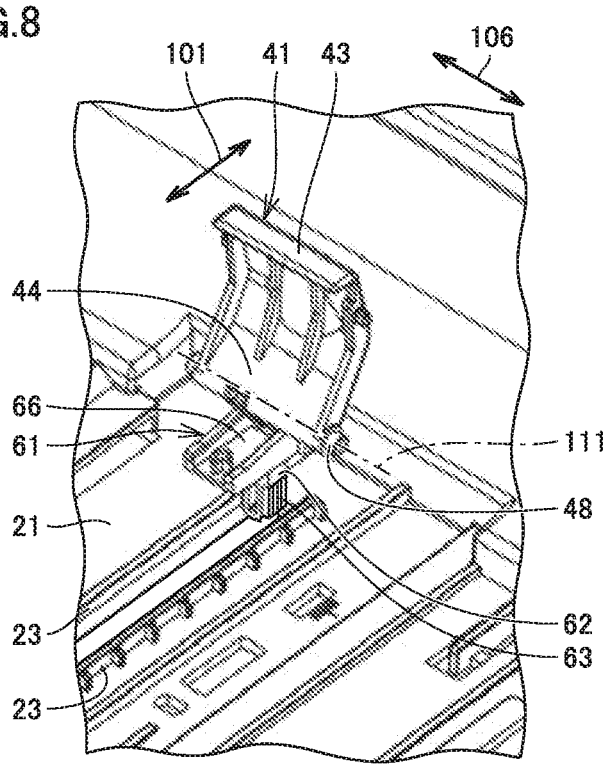
FIG. 8 is a perspective view of the cassette, the locking portion, and the lever (during unlocking).
Figure 9:
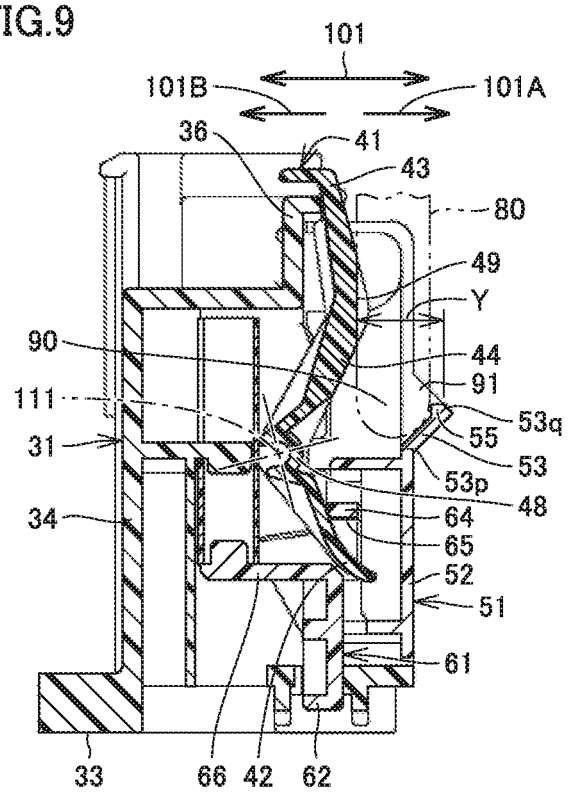
FIG. 9 is a sectional view of the paper feed tray (during unlocking).

FIG. 8 is a perspective view of the cassette, the locking portion, and the lever (during unlocking). FIG. 9 is a sectional view of the paper feed tray (during unlocking). FIG. 9 shows a cross-section of the paper feed tray corresponding to FIG. 7.

Referring to FIGS. 4 to 9, regulation plate 31 includes a bottom portion 33, a wall portion 34, and a facing portion 36 as its components.

Bottom portion 33 is provided on the bottom of regulation plate 31. Bottom portion 33 is provided directly above cassette 21. Bottom portion 33 slidably contacts cassette 21 as regulation plate 31 slides.

Wall portion 34 rises from bottom portion 33 and has a wall shape. Wall portion 34, together with cover 51, defines an interior space covering locking portion 61 and part of lever 41. Wall portion 34 partitions a space, in which sheets of paper are placed between regulation plate 31 and regulation plate 32, and a space, in which the lock/unlock mechanism of regulation plate 31 by locking portion 61 and lever 41 is disposed, from each other.

Facing portion 36 is provided above wall portion 34. Facing portion 36 faces lever 41 (depression portion 43 described below) with a spacing therebetween in the direction indicated by arrow 101.

Lever 41 is provided to regulation plate 31. Lever 41 is partially covered with cover 51. Lever 41 is operated by the user to cause locking portion 61 to perform an unlocking operation.

Lever 41 includes depression portion 43, an intermediate portion 44, a rotation shaft 48, and a coupling portion 42 as its components. Lever 41 is made of, for example, resin integrally forming depression portion 43, intermediate portion 44, rotation shaft 48, and coupling portion 42.

Lever 41 has the shape of a lever extending in the up-down direction as a whole. Depression portion 43 is provided at one end of lever 41, and coupling portion 42 is provided at the other end of lever 41. Intermediate portion 44 is provided between depression portion 43 and coupling portion 42. Rotation shaft 48 is provided between intermediate portion 44 and coupling portion 42.

Rotation shaft 48 is provided at a position higher than that of coupling portion 42. Intermediate portion 44 is provided at a position higher than that of rotation shaft 48. Depression portion 43 is provided at a position higher than that of intermediate portion 44. Depression portion 43 is provided at the upper end of lever 41, and coupling portion 42 is provided at the lower end of lever 41.

Rotation shaft 48 is covered with cover 51. Rotation shaft 48 runs axially along a center of rotation 111. Center of rotation 111 is an imaginary straight line running in the direction indicated by arrow 106. Rotation shaft 48 is supported by regulation plate 31 so as to rotate about center of rotation 111. Lever 41 is rotatable about center of rotation 111.

Lever 41 extends upward in a plate shape from rotation shaft 48 through intermediate portion 44 toward depression portion 43. Lever 41 extends diagonally upward from rotation shaft 48 through intermediate portion 44 toward depression portion 43. Depression portion 43 is provided at the top of regulation plate 31. Depression portion 43 is provided outside of cover 51.

Lever 41 extends downward in an arm shape from rotation shaft 48 to coupling portion 42. Lever 41 extends diagonally downward from rotation shaft 48 toward coupling portion 42. Lever 41 has the shape of a cross-section bent with rotation shaft 48 as a corner as a whole. The length (width) of coupling portion 42 in the direction indicated by arrow 106 is smaller than the length (width) of depression portion 43 in the direction indicated by arrow 106. Coupling portion 42 is covered with cover 51. Coupling portion 42 is coupled to locking portion 61. Coupling portion 42 is inserted into hole 65 provided in receiving portion 64 of locking portion 61.

Depression portion 43 is configured to be depressed toward one side (the side indicated by an arrow 101B in FIG. 7) in the direction of sliding of regulation plate 31. When the user depresses depression portion 43 toward the side indicated by arrow 101B, lever 41 rotates counterclockwise in FIG. 7 about center of rotation 111. At this time, receiving portion 64 is flipped up by coupling portion 42, causing locking portion 61 to move upward. As locking portion 61 comes out of the pair of rack portions 23, releasing the lock of regulation plate 31 by locking portion 61.

Subsequently, the user can slide regulation plate 31 in the direction indicated by arrow 101 while pinching depression portion 43 and facing portion 36 with the fingers to adjust the distance between regulation plate 31 and regulation plate 32.

Although the present embodiment has described the configuration in which depression portion 43 is provided at one end (upper end) of lever 41 and coupling portion 42 is provided at the other end (lower end) of lever 41, the present invention is not limited thereto. For example, the coupling portion coupled to the locking portion may be provided at a position close to the intermediate portion relative to the other end of the lever.

Cover 51 includes a main body 52 and an extension 53 as its components. Main body 52 constitutes the main part of cover 51 covering locking portion 61 and part of lever 41. Main body 52 defines an interior space covering locking portion 61 and part of lever 41, together with wall portion 34 of regulation plate 31.

Main body 52 has an opening 54 (see FIG. 4). Opening 54 is open across the front surface and the upper surface of cover 51. Opening 54 forms an opening surface having a rectangular shape in front view of cover 51 as viewed in the direction indicated by arrow 101B. Opening 54 forms an opening surface having a rectangular shape in top view of cover 51. Lever 41 is exposed to the outside of cover 51 through opening 54 across intermediate portion 44 and depression portion 43.

Extension 53 is provided opposite to the one side (the side in the direction indicated by arrow 101A in FIG. 7) with lever 41 therebetween. Extension 53 extends while facing intermediate portion 44. Extension 53 extends from main body 52 toward the outside of cover 51.

Extension 53 includes a base end 53*p* and a tip end 53*q* as its components. Base end 53*p* is continuous with main body 52. Tip end 53*q* is located at the tip of extension 53. Extension 53 runs linearly from base end 53*p* toward tip end 53*q*. Extension 53 runs diagonally upward from base end 53*p* toward tip end 53*q*. Extension 53 extends in a plate shape in the direction indicated by arrow 106 and is connected to an opening edge of opening 54 at its opposite ends.

A space 90 is defined between extension 53 and intermediate portion 44. Space 90 is located opposite to the one side (the side in the direction indicated by arrow 101A in FIG. 7) with lever 41 therebetween. Space 90 is open at the tip to which extension 53 extends. Space 90 has an opening 91 open at the tip to which extension 53 extends.

As shown in FIG. 4, opening 91 has the shape of an elongated opening that has a longitudinal direction, which is the direction indicated by arrow 106, and a transverse direction, which is the direction orthogonal to the direction indicated by arrow 106. Space 90 is open diagonally upward. Opening 91 has the shape of an opening facing diagonally upward. Opening 91 forms an opening having a shape of a mouth with a protruding lower jaw.

Cover 51 further includes a protrusion 55 as its component. Protrusion 55 projects from extension 53 toward intermediate portion 44. Protrusion 55 is provided at tip end 53*q*. Protrusion 55 extends linearly in the direction indicated by arrow 106 while having a projecting cross-section projecting from the surface of extension 53.

Intermediate portion 44 is provided with a dent 49. Dent 49 forms the shape of a recess dent from the surface of intermediate portion 44 on the side opposite to the one side (the side in the direction indicated by arrow 101A in FIG. 7) with lever 41 therebetween. Dent 49 is provided at the center portion of intermediate portion 44 in the direction indicated by arrow 106. Dent 49 is provided immediately above opening 91.

Presumably, it is difficult for a user, for example, who is a person with disabilities with the hands, to adopt an operation method of sliding regulation plate 31 while depression portion 43. Contrastingly, in the present embodiment, depression portion 43 can be moved toward the one side indicated by arrow 101B by inserting a member 80, such as finger or elongated body, through opening 91 into space 90 defined between extension 53 and intermediate portion 44. This allows the user to adopt the operation method of sliding regulation plate 31 while inserting member 80 such as finger or elongated body into space 90 as shown in FIG. 9, thereby adjusting the position of regulation late 31. Consequently, the position of regulation plate 31 can be adjusted easily even when the user is a person with disabilities with the hands.

Also, cover 51 is provided with protrusion 55 projecting from extension 53 toward intermediate portion 44. With such a configuration, when the user slides regulation plate 31 as shown in FIG. 9, member 80 such as finger or elongated body is caught by protrusion 55, thus making it difficult for the member to come out of space 90. This improves the operability in adjustment of the position of regulation plate 31.

As shown in FIG. 7, the length between intermediate portion 44 and tip end 53*q* in the direction in which intermediate portion 44 and extension 53 face each other is X. As shown in FIG. 9, with depression portion 43 being depressed toward one side, the length between lever 41 and tip end 53*q* in the direction of sliding of regulation plate 31 is Y. In this case, a relationship $Y \leq X$ may be satisfied.

Such a configuration causes member 80 such as finger or elongated member to be inserted into a narrower space when the user slidably moves regulation plate 31. This allows member 80 such as finger or elongated member to be held stably in space 90, thus improving the operability in adjustment of the position of regulation plate 31.

As shown in FIG. 7, a length (H1) between bottom portion 33 and intermediate portion 44 in the height direction is smaller than a length (H2) between bottom portion 33 and depression portion 43 in the height direction (H1<H2).

Such a configuration allows the position at which the force from the user is exerted on regulation plate 31 to be closer to bottom portion 33 which slidably contacts cassette 21 in the height direction. This allows the force from the user to easily act in the direction of sliding of regulation plate 31 when the user slides regulation plate 31, thus improving the operability in adjustment of the position of regulation plate 31.

Space 90 is open diagonally upward. Such a configuration allows the user to easily recognize the presence of space 90 for inserting member 80 such as finger or elongated member thereinto in adjustment of the position of regulation plate 31. Consequently, the operation method of sliding regulation plate 31 while inserting member 80 such as finger or elongated member into space 90 can be implicitly presented to the user if this operation method is not expressed clearly. Also, dent 49 provided in intermediate portion 44 can function similarly.

The structure of paper feed tray 10 in Embodiment 1 of the present invention described above will be summarized as follows. Paper feed tray 10 in the present embodiment includes cassette 21 in which a sheet of paper is placed, regulation plate 31 which is slidably attached to cassette 21 and regulates a position of the sheet of paper, cover 51 provided to regulation plate 31, locking portion 61 which is covered with the cover 51 and engages with cassette 21 to fix a position of regulation plate 31, and lever 41. Lever 41 is covered with cover 51, and includes coupling portion 42 coupled with locking portion 61, depression portion 43 configured to be depressed toward one side in a direction of sliding of regulation plate 31, and intermediate portion 44 provided between coupling portion 42 and depression portion 43. Lever 41 operates locking portion 61 to be disengaged from cassette 21 upon depression portion 43 being depressed toward the one side. Cover 51 is provided opposite to the one side with lever 41 therebetween and includes extension 53 extending while facing intermediate portion 44. Space 90, which is open at a tip to which extension 53 extends, is provided between extension 53 and intermediate portion 44.

Paper feed tray 10 and image forming apparatus 100 in Embodiment 1 of the present invention configured as described above allow the user to adopt the operation method of sliding regulation plate 31 while inserting member 80 such as finger or elongated member into space 90, in addition to the operation method of sliding regulation plate 31 while depressing depression portion 43. As a result, the position of regulation plate 31 can be adjusted easily even when, for example, the user is a person with disabilities with the hands.

Embodiment 2

Figure 10:
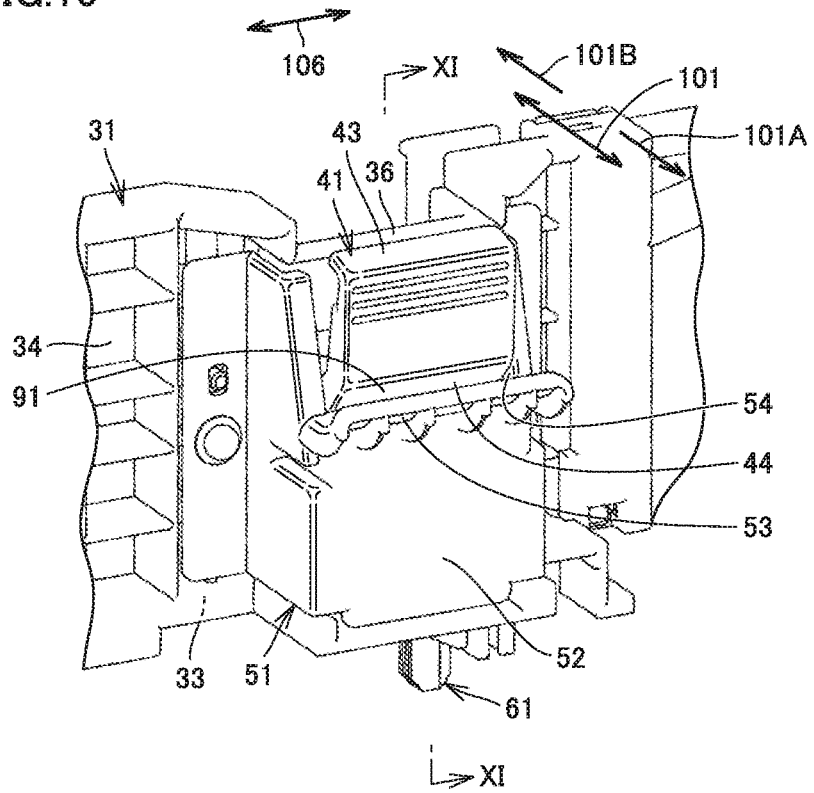
FIG. 10 is a perspective view of part of a paper feed tray in Embodiment 2 of the present invention.
Figure 11:
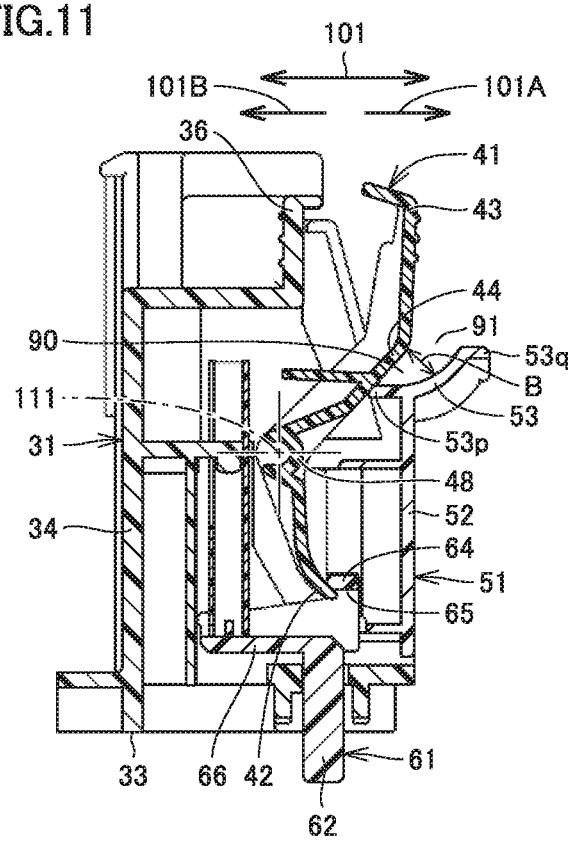
FIG. 11 is a sectional view of the paper feed tray (during locking) as viewed in the direction indicated by a line XI-XI in FIG. 10.
Figure 12:
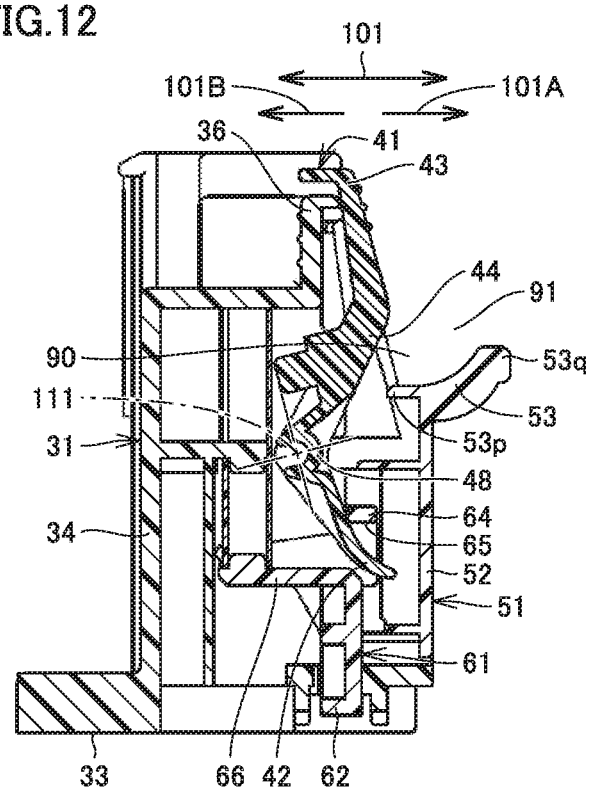
FIG. 12 is a sectional view of the paper feed tray (during unlocking).

FIG. 10 is a perspective view of part of a paper feed tray in Embodiment 2 of the present invention. FIG. 10 corresponds to FIG. 4 in Embodiment 1. FIG. 11 is a sectional view of the paper feed tray (during locking) as viewed in the direction indicated by a line XI-XI in FIG. 10. FIG. 12 is a sectional view of the paper feed tray (during unlocking). FIGS. 11 and 12 correspond to FIGS. 7 and 9 in Embodiment 1, respectively.

In comparison, the paper feed tray in the present embodiment basically has a configuration similar to that of paper feed tray 10 in Embodiment 1. Description of the overlapping features will not be repeated below.

Referring to FIGS. 10 to 12, cover 51 includes extension 53 as its component. Extension 53 includes base end 53*p* and tip end 53*q* as its components.

In the present embodiment, extension 53 is not connected to the open edge of opening 54 at the opposite ends at which extension 53 extends in a plate shape in the direction indicated by arrow 106. Space 90 is open at the opposite ends in the direction (the direction indicated by arrow 106) orthogonal to the direction of sliding of regulation plate 31 (the direction indicated by arrow 101).

Such a configuration enables the adoption of the operation method of sliding regulation plate 31 while inserting an elongated body such as pencil into space 90 such that the direction orthogonal to the direction of sliding of regulation plate 31 is the longitudinal direction. This extends the range of choices of the operation method by the user, thus improving the operability in adjustment of the position of regulation plate 31.

The length of space 90 in the direction in which intermediate portion 44 and extension 53 face each other decreases from tip end 53*q* toward base end 53*p*. Space 90 has a taped shape as viewed from the opening 91 side.

Such a configuration allows depression portion 43 to move toward one side more reliably irrespective of the size of the member such as finger or elongated body when this member is inserted into space 90.

The paper feed tray in Embodiment 2 of the present invention configured as described above can similarly achieve the effects described in Embodiment 1.

The configurations of the paper feed tray and the image forming apparatus described above and the functions and effects achieved by the paper feed tray and the image forming apparatus will be summarized as follows.

A paper feed tray includes a cassette in which a sheet of paper is placed, a regulation plate which is slidably attached to the cassette and regulates a position of the sheet of paper, a cover provided to the regulation plate, a locking portion which is covered with the cover and engages with the cassette to fix a position of the regulation plate, and a lever. The lever includes a coupling portion covered with the cover and coupled with the locking portion, a depression portion configured to be depressed toward one side in a direction of sliding of the regulation plate, and an intermediate portion provided between the coupling portion and the depression portion. The lever operates the locking portion to be disengaged from the cassette upon the depression portion being depressed toward the one side. The cover includes an extension provided opposite to the one side with the lever therebetween and extending while facing the intermediate portion. A space, which is open at a tip to which the extension extends, is provided between the extension and the intermediate portion.

The paper feed tray configured as described above forms a space, which is open at the tip to which the extension extends, between the extension and the intermediate portion. Since the extension is provided opposite to one side that is the direction in which the depression portion is depressed with the lever therebetween, the depression portion can be moved toward the one side by inserting the member such as finger or elongated body into the space defined between the extension and the intermediate portion. This allows the user to adopt the operation method of sliding the regulation plate while inserting the member such as finger or elongated body into the space to adjust the position of the regulation plate. Consequently, the operability in adjustment of the position of the regulation plate can be improved.

Preferably, the cover further includes a protrusion projecting from the extension toward the intermediate portion.

With the paper feed tray configured as described above, when the user adopts the operation method of sliding the regulation plate while inserting a member such as finger or elongated body into the space, the member such as finger or elongated body is caught by the protrusion. This makes it difficult for the member such as finger or elongated body to come out of the space when the regulation plate is slid, thereby further improving the operability in adjustment of the position of the regulation plate.

Preferably, the extension has a tip end forming an opening of the space at the tip to which the extension extends. A relationship $Y \leq X$ is satisfied, where X represents a length between the intermediate portion and the tip end in a direction in which the intermediate portion and the extension face each other, and Y represents a length between the intermediate portion and the tip end in the direction of sliding of the regulation plate with the depression portion being depressed toward the one side.

With the paper feed tray configured as described above, when the user adopts the operation method of sliding the regulation plate while inserting a member such as finger or elongated body into the space, the member such as finger or elongated body is inserted into a narrower space. This makes it difficult for the member such as finger or elongated body to come out of the space when the regulation plate is slid, thereby further improving the operability in adjustment of the position of the regulation plate.

Preferably, the regulation plate has a bottom portion which slidably contacts the cassette as the regulation plate slides. A length between the bottom portion and the intermediate portion in a height direction is smaller than a length between the bottom portion and the depression portion in the height direction.

With the paper feed tray configured as described above, when the user adopts the operation method of sliding the regulation plate while inserting a member such as finger or elongated body into the space, the position at which the force from the user is exerted on the regulation plate can be made closer to the bottom portion which slidably contacts the cassette in the height direction. Consequently, the force from the user is easily exerted in the direction of sliding of the regulation plate when the regulation plate is slid, thereby further improving the operability in adjustment of the position of the regulation plate.

Preferably, the space is open diagonally upward.

The paper feed tray configured as described above allows the user to easily recognize the presence of the space for inserting a member such as finger or elongated body in adjustment of the position of the regulation plate.

Preferably, the space is open further at opposite ends in a direction orthogonal to the direction of sliding of the regulation plate.

The paper feed tray configured as described above allows the user to adopt the operation method of sliding the regulation plate while inserting an elongated body such as pencil into the space such that the direction orthogonal to the direction of sliding of the regulation plate is the longitudinal direction.

Preferably, the extension has a base end and a tip end forming an opening of the space at a tip extending from the base end. A length of the space in the direction in which the intermediate portion and the extension face each other decreases from the tip end toward the base end.

The paper feed tray configured as described above can move the depression portion toward the one side more reliably irrespective of the size of the member such as finger or elongated body inserted into the space.

An image forming apparatus includes the paper feed tray according to any one of the above, and an apparatus body to which the paper feed tray is attached.

The image forming apparatus configured as described above can include a paper feed tray having excellent operability in adjustment of the position of the regulation plate.

The present invention is mainly applied to a paper feed tray attached to an image forming apparatus.

Although embodiments of the present invention have been described and illustrated in detail, the disclosed embodiments are made for purposes of illustration and example only and not limitation. The scope of the present invention should be interpreted by terms of the appended claims

What is claimed is:

1. A paper feed tray comprising:

a cassette in which a sheet of paper is placed;

a regulation plate which is slidably attached to the cassette and regulates a position of the sheet of paper;

a cover provided to the regulation plate;

a locking portion which is covered with the cover and engages with the cassette to fix a position of the regulation plate; and a lever including a coupling portion covered with the cover and coupled with the locking portion, a depression portion configured to be depressed toward one side in a direction of sliding of the regulation plate, and an intermediate portion provided between the coupling portion and the depression portion, the lever operating the locking portion to be disengaged from the cassette upon the depression portion being depressed toward the one side, wherein the cover is attached to the regulation plate from a side of the regulation plate opposite to the one side, or is integral with the regulation plate, the cover is configured to move with the regulation plate as the regulation plate is slid relative to the cassette, the cover includes an extension provided opposite to the one side with the lever therebetween and extending while facing the intermediate portion, and a space is provided between the extension and the intermediate portion, the space being open at a tip to which the extension extends.

2. The paper feed tray according to claim 1, wherein the extension has a tip end forming an opening of the space at the tip to which the extension extends, and a relationship $Y \leq X$ is satisfied, where X represents a length between the intermediate portion and the tip end in a direction in which the intermediate portion and the extension face each other, and Y represents a length between the intermediate portion and the tip end in the direction of sliding of the regulation plate with the depression portion being depressed toward the one side.

3. The paper feed tray according to claim 1, wherein the regulation plate has a bottom portion which slidably contacts the cassette as the regulation plate slides, and a length between the bottom portion and the intermediate portion in a height direction is smaller than a length between the bottom portion and the depression portion in the height direction.

4. The paper feed tray according to claim 1, wherein the space is open diagonally upward.

5. The paper feed tray according to claim 1, wherein the extension has a base end and a tip end forming an opening of the space at a tip extending from the base end, and a length of the space in a direction in which the intermediate portion and the extension face each other decreases from the tip end toward the base end.

6. An image forming apparatus comprising:

a paper feed tray according to claim 1; and an apparatus body to which the paper feed tray is attached.

7. A paper feed tray comprising:

a cassette in which a sheet of paper is placed;

a regulation plate which is slidably attached to the cassette and regulates a position of the sheet of paper;

a cover provided to the regulation plate;

a locking portion which is covered with the cover and engages with the cassette to fix a position of the regulation plate; and a lever including a coupling portion covered with the cover and coupled with the locking portion, a depression portion configured to be depressed toward one side in a direction of sliding of the regulation plate, and an intermediate portion provided between the coupling portion and the depression portion, the lever operating the locking portion to be disengaged from the cassette upon the depression portion being depressed toward the one side, wherein the cover includes an extension provided opposite to the one side with the lever therebetween and extending while facing the intermediate portion, and a space is provided between the extension and the intermediate portion, the space being open at a tip to which the extension extends, wherein the cover further includes a protrusion projecting from the extension toward the intermediate portion.

8. An image forming apparatus comprising:

a paper feed tray according to claim 7; and an apparatus body to which the paper feed tray is attached.

9. A paper feed tray comprising:

a cassette in which a sheet of paper is placed;

a regulation plate which is slidably attached to the cassette and regulates a position of the sheet of paper;

a cover provided to the regulation plate;

a locking portion which is covered with the cover and engages with the cassette to fix a position of the regulation plate; and a lever including a coupling portion covered with the cover and coupled with the locking portion, a depression portion configured to be depressed toward one side in a direction of sliding of the regulation plate, and an intermediate portion provided between the coupling portion and the depression portion, the lever operating the locking portion to be disengaged from the cassette upon the depression portion being depressed toward the one side, wherein the cover includes an extension provided opposite to the one side with the lever therebetween and extending while facing the intermediate portion, and a space is provided between the extension and the intermediate portion, the space being open at a tip to which the extension extends, wherein the space is open at opposite ends in a direction orthogonal to the direction of sliding of the regulation plate.

10. An image forming apparatus comprising:
a paper feed tray according to claim 9; and
an apparatus body to which the paper feed tray is attached.

* * * * *